US010507658B2

(12) United States Patent
Wang

(10) Patent No.: US 10,507,658 B2
(45) Date of Patent: Dec. 17, 2019

(54) LIQUID EJECTION APPARATUS

(71) Applicant: Brother Kogyo Kabushiki Kaisha, Nagoya-shi, Aichi-ken (JP)

(72) Inventor: Rui Wang, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/939,560

(22) Filed: Mar. 29, 2018

(65) Prior Publication Data

US 2019/0092014 A1 Mar. 28, 2019

(30) Foreign Application Priority Data

Sep. 27, 2017 (JP) ..... 2017-186025

(51) Int. Cl.
*B41J 2/14* (2006.01)

(52) U.S. Cl.
CPC ..... *B41J 2/14233* (2013.01); *B41J 2/1433* (2013.01); *B41J 2/14072* (2013.01); *B41J 2/14274* (2013.01); *B41J 2002/14241* (2013.01); *B41J 2002/14419* (2013.01); *B41J 2002/14491* (2013.01)

(58) Field of Classification Search
CPC ..... B41J 2/14072; B41J 2/1433; B41J 2/14; B41J 2002/14491
See application file for complete search history.

(56) References Cited

U.S. PATENT DOCUMENTS

2009/0167821 A1* 7/2009 Sugahara ..... B41J 2/14233 347/68
2011/0205270 A1* 8/2011 Miyata ..... B41J 2/14233 347/9
2011/0234707 A1 9/2011 Gao
2016/0031214 A1 2/2016 Okui et al.
2019/0143696 A1* 5/2019 Yamamura ..... B41J 2/1433 347/29

FOREIGN PATENT DOCUMENTS

JP 2011-194783 A 10/2011
JP 2016-034740 A 3/2016

* cited by examiner

*Primary Examiner* — Scott A Richmond
(74) *Attorney, Agent, or Firm* — Banner & Witcoff, Ltd.

(57) ABSTRACT

A liquid ejection apparatus includes: channel rows each including individual channels; piezoelectric elements each constituted by an individual electrode, a common electrode, and a piezoelectric layer; and individual wires respectively extending from the individual electrodes to an outside connecting region, connectable to an external circuit board, and each having a contact connectable to an individual terminal of the external circuit board. A portion of each of the channel rows has an intra-row void between adjacent two of the individual channels. Each of the individual wires extends to a portion of the outside connecting region which corresponds to one of the individual channels. A first common wire extending from the common electrode and connectable to a common terminal of the external circuit board is provided at a portion of the outside connecting region which corresponds to the intra-row void.

16 Claims, 13 Drawing Sheets

LIQUID EJECTION APPARATUS

CROSS REFERENCE TO RELATED APPLICATION

The present application claims priority from Japanese Patent Application No. 2017-186025, which was filed on Sep. 27, 2017, the disclosure of which is herein incorporated by reference in its entirety.

BACKGROUND

The following disclosure relates to a liquid ejection apparatus.

A conventional liquid ejection apparatus includes a multiplicity of piezoelectric elements configured to apply ejection pressure to liquid and arranged in rows. Each of the piezoelectric elements includes a piezoelectric layer interposed between an individual electrode as a driving electrode and a common electrode as a ground electrode. When a voltage is applied to the electrodes, the piezoelectric element is driven to apply the ejection pressure to the liquid. The common electrode is elongated in an arrangement direction, in which the piezoelectric elements are arranged, so as to cover these piezoelectric elements. The common electrode is connected to an external wire or board such as a Chip-on-Film (COF) via terminals provided on opposite end portions of the common electrode. In such a configuration, however, a piezoelectric element located near a center of the row in the arrangement direction is farther from the terminal for connection to the external wire or board than a piezoelectric element located near an end portion of the row in the arrangement direction. A voltage applied to the piezoelectric element decreases with increase in distance from the connection terminal, resulting in smaller amount of deformation of the piezoelectric element.

There is known a configuration for uniform voltages applied to piezoelectric elements. Specifically, there is known a liquid ejection head including individual electrodes and a common electrode, and this liquid ejection head is configured such that substantial driven portions (piezoelectric active portions) of respective piezoelectric elements defined by these electrodes are provided at regions respectively opposed to pressure generation chambers. The common electrode and a wire electrode provided along a direction in which the piezoelectric active portions are arranged are connected to each other by a common lead electrode provided between the piezoelectric active portions. This configuration ensures more uniform voltages applied to the respective piezoelectric elements.

SUMMARY

In the above-described liquid ejection head, however, the common lead electrode is provided at a small space between the adjacent piezoelectric active portions, resulting in small width of the common lead electrode. Thus, when the common lead electrode and the wire electrode are connected to each other, the common lead electrode and the wire electrode may be short-circuited with the individual electrode, or poor or faulty electrical connection may occur between the common lead electrode and the wire electrode.

Accordingly, an aspect of the disclosure relates to a liquid ejection apparatus configured to ensure more uniform voltages applied to piezoelectric layers with reduction in poor or faulty electrical connection.

In one aspect of the disclosure, a liquid ejection apparatus includes: a plurality of channel rows each having a plurality of individual channels to which liquid is to be supplied, the plurality of individual channels being arranged in an arrangement pitch in an arrangement direction; a plurality of piezoelectric elements each constituted by an individual electrode, a common electrode, and a piezoelectric layer interposed between the individual electrode and the common electrode, the plurality of piezoelectric elements each provided for a corresponding one of the plurality of individual channels; and a plurality of individual wires respectively extending from a plurality of individual electrodes, each as the individual electrode, to an outside connecting region located adjacent to the plurality of channel rows, the plurality of individual wires being to be connected to an external circuit board, the plurality of individual wires each including a contact to be connected to an individual terminal of the external circuit board. A portion of each of the plurality of channel rows in the arrangement direction has an intra-row void that is a region between two of the plurality of individual channels, which two are adjacent to and spaced apart from each other at a distance greater than the arrangement pitch. Each of the plurality of individual wires extends to a portion of the outside connecting region which corresponds to a corresponding one of the plurality of individual channels. A first common wire extending from the common electrode and to be connected to a common terminal of the external circuit board is provided at a portion of the outside connecting region which corresponds to the intra-row void.

In another aspect of the disclosure, a liquid ejection apparatus includes: a plurality of channel rows each having a plurality of individual channels to which liquid is to be supplied, the plurality of individual channels being arranged in an arrangement pitch in an arrangement direction; a plurality of piezoelectric elements each constituted by an individual electrode, a common electrode, and a piezoelectric layer interposed between the individual electrode and the common electrode, the plurality of piezoelectric elements each provided for a corresponding one of the plurality of individual channels; and a plurality of individual wires respectively extending from a plurality of individual electrodes, each as the individual electrode, to an outside connecting region located adjacent to the plurality of channel rows, the plurality of individual wires being to be connected to an external circuit board, the plurality of individual wires each including a contact to be connected to an individual terminal of the external circuit board. Each of the plurality of channel rows has an intra-row void that is a region between a first individual channel and a second individual channel of the plurality of individual channels, and the first individual channel and the second individual channel are adjacent to each other and spaced apart from each other at a distance greater than the arrangement pitch. A first common wire extending from the common electrode and to be connected to a common terminal of the external circuit board is provided at the outside connecting region at a position between a first individual wire extending from the first individual channel to the outside connecting region and a second individual wire extending from the second individual channel to the outside connecting region.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

First Embodiment

Hereinafter, there will be described liquid ejection apparatuses according to embodiments by reference to the drawings. It is noted that the following description is provided for a printer including ejection heads each configured to eject ink to record an image on a recording medium such as a sheet, and the ejection head is one example of the liquid ejection apparatus.

Overall Configuration of Printer

Figure 1:
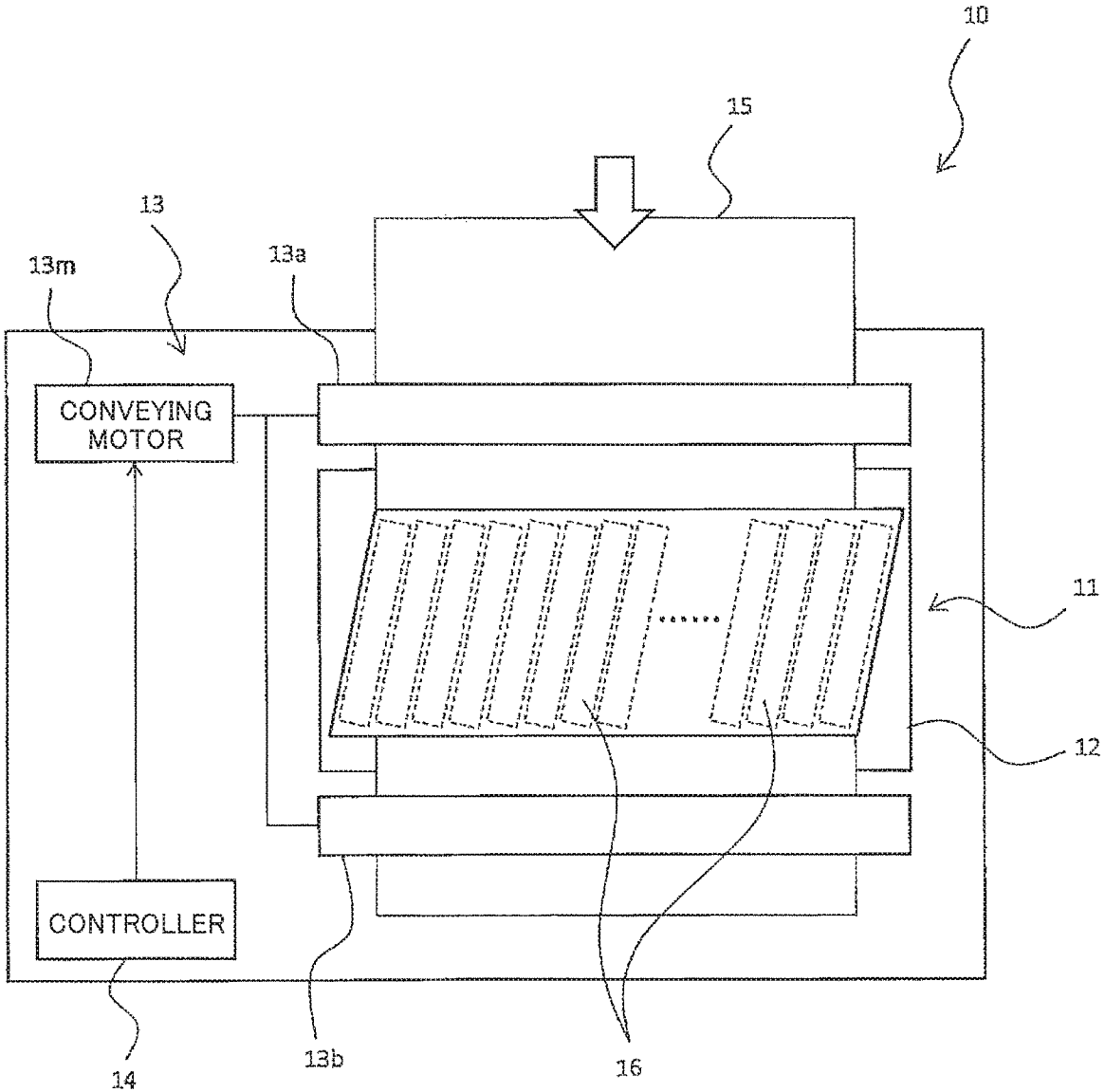
FIG. 1 is a schematic plan view of a printer including liquid ejection apparatuses according to a first embodiment.

As illustrated in FIG. 1, a printer 10 includes a head unit 11, a platen 12, a conveying mechanism 13, and a controller 14. While the conveying mechanism 13 is conveying a recording medium 15 in a predetermined direction, ink is ejected from the head unit 11 onto the conveyed recording medium 15 to print an image on the recording medium 15.

The head unit 11 is fixed in the printer 10. That is, this head unit 11 is a line head unit configured to eject the ink onto the recording medium 15 in a state in which the position of the head unit 11 is fixed. The head unit 11 is elongated in a direction orthogonal to a direction in which the recording medium 15 is conveyed (hereinafter may be referred to as "conveying direction"). The head unit 11 includes a plurality of ejection heads 16 arranged in the longitudinal direction of the head unit 11. Each of the ejection heads 16 has a substantially rectangular shape in plan view, and its longitudinal direction is inclined at a predetermined angle with respect to the conveying direction. Since the ejection heads 16 have the same configuration, the following description will be provided for one of the ejection heads 16 for simplicity unless otherwise required by context. The ejection head 16 has a multiplicity of nozzles 30*f* (see FIG. 3A) from which the ink is ejected.

The platen 12 is a flat plate disposed just below the head unit 11. The platen 12 supports the recording medium 15 by contacting a lower surface of the recording medium 15 to be printed.

The conveying mechanism 13 includes: a roller pair 13*a* disposed upstream of the platen 12 in the conveying direction; a roller pair 13*b* disposed downstream of the platen 12 in the conveying direction; and a conveying motor 13*m* configured to drive these roller pairs 13*a*, 13*b*. The upstream roller pair 13*a* is constituted by an upper roller and a lower roller. These rollers are rotated by the conveying motor 13*m* respectively in directions reverse to each other to convey the recording medium 15 in the conveying direction, with the recording medium 15 nipped by the two rollers. The configuration and operations of the downstream roller pair 13*b* are the same as those of the roller pair 13*a*.

The controller 14 includes: a computer including a processor; and a storage including a memory accessible by the computer. The computer is operated according to programs stored in the storage to control operations of the devices and components of the printer 10. Examples of the operations include: conveyance of the recording medium 15 by the conveying mechanism 13; and ejection of the ink onto the recording medium 15 by the head unit 11.

Ejection Head

Figure 2:
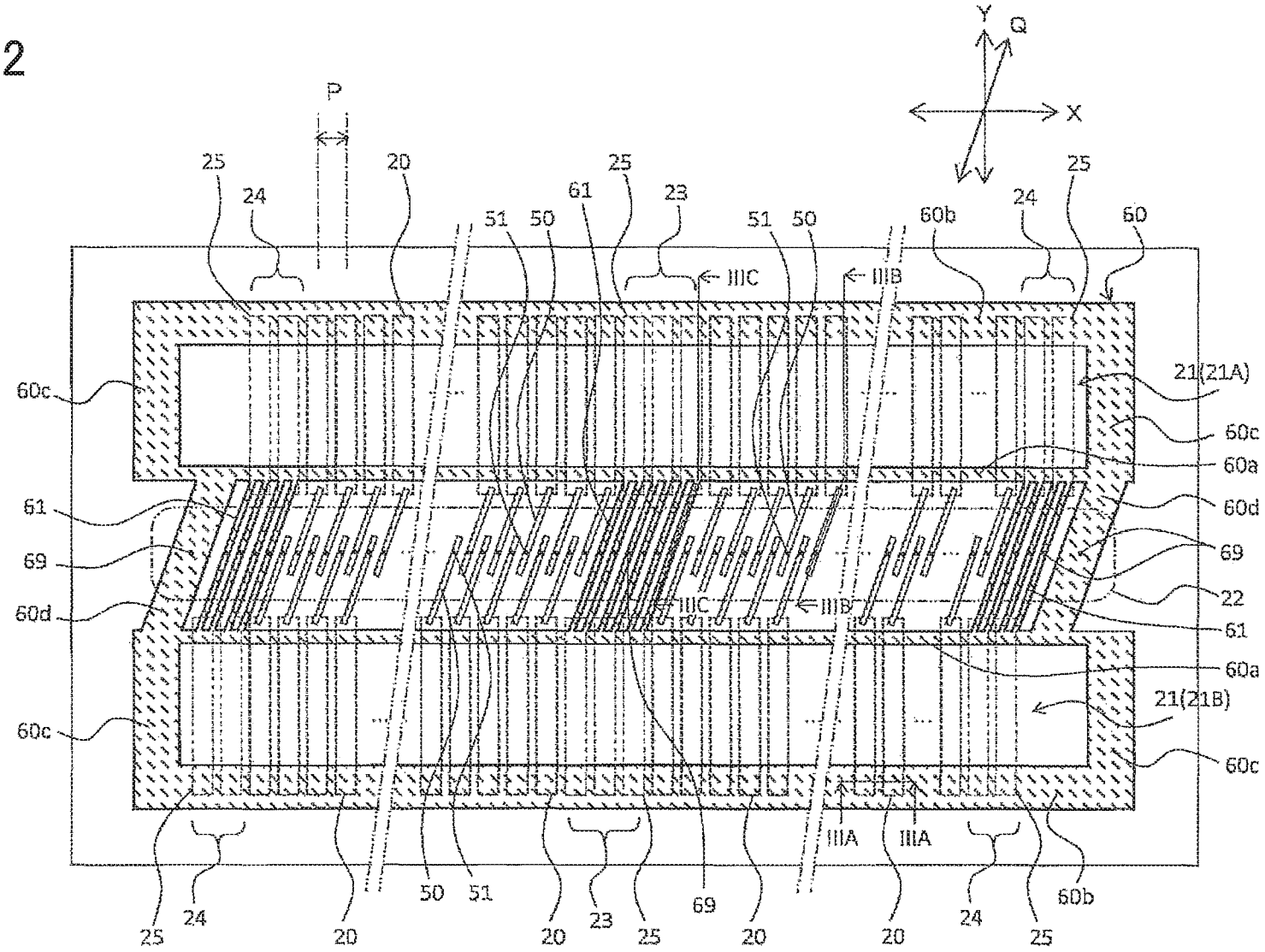
FIG. 2 is a plan view of the liquid ejection apparatus of the printer in FIG. 1.

There will be next described a configuration of the ejection head 16 with reference to FIGS. 2 and 3.

The ejection head 16 has a multiplicity of individual channels 20 (indicated by broken lines in FIG. 2) to which the ink to be ejected from the nozzles 30*f* is supplied. In the present embodiment, as illustrated in FIG. 2, the individual channels 20 are arranged in the longitudinal direction of the ejection head 16 in two rows, namely, two channel rows 21. In each channel row 21, the individual channels 20 are arranged at a predetermined pitch. In the following description, in the case where there is a need to distinguish between the two channel rows 21, the channel rows 21 will be referred to as "first channel row 21A" and "second channel row 21B", respectively.

An outside connecting region 22 is provided between these two channel rows 21 so as to be contiguous to the channel rows 21. This outside connecting region 22 is defined as a region at which the ejection head 16 is connected to a Chip-on-Film (COF) 100 as one example of an external circuit board.

It is noted that the pitch and directions in the present embodiment are defined as follows: the pitch in which the individual channels 20 are arranged in each row is an arrangement pitch P; the direction in which the individual channels 20 are arranged in each row is an arrangement direction X which coincides with the longitudinal direction of the ejection head 16 in the present embodiment; the direction orthogonal to the arrangement direction X is an orthogonal direction Y; and the direction orthogonal to each of the arrangement direction X and the orthogonal direction Y is an up and down direction Z.

Figure 3A:
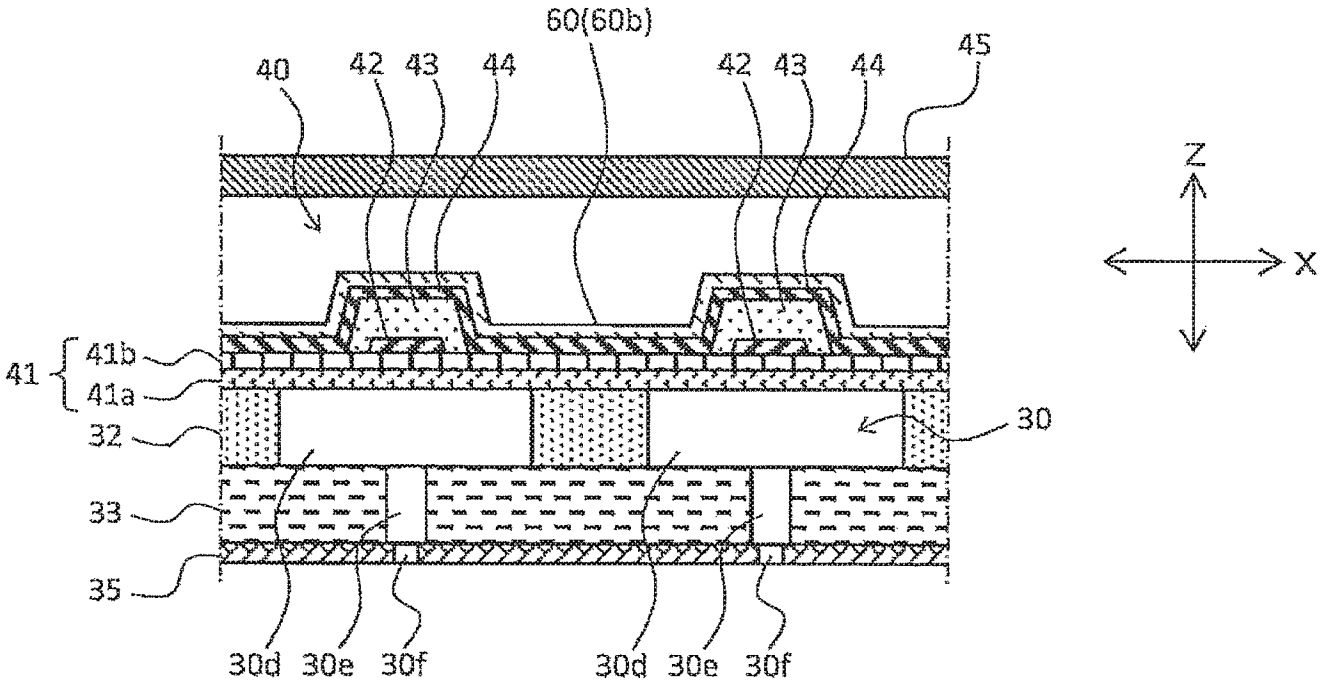
FIG. 3A is a cross-sectional view taken along line IIIA-IIIA in FIG. 2.
Figure 3B:
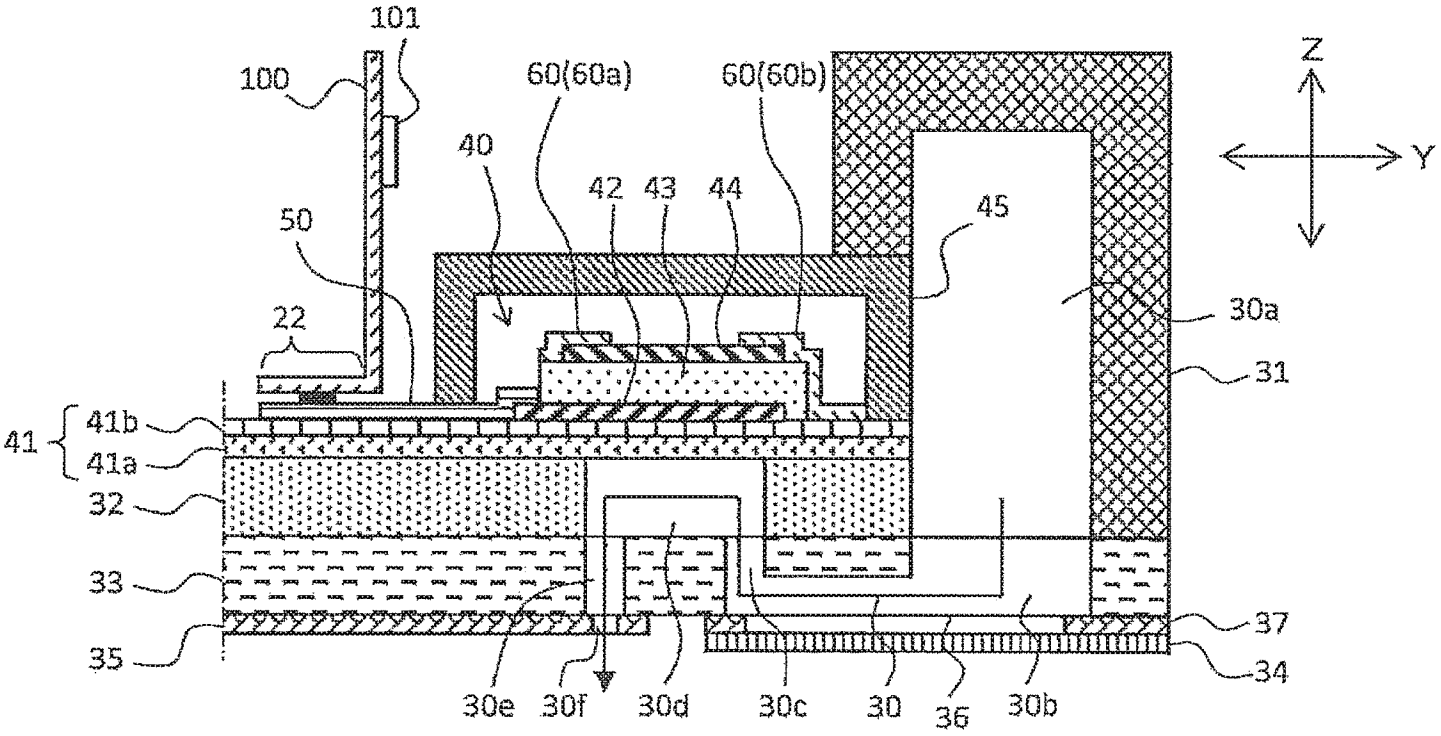
FIG. 3B is a cross-sectional view taken along line IIIB-IIIB in FIG. 2.

As illustrated in FIGS. 3A and 3B, the ejection head 16 includes ink passages 30 and piezoelectric elements 40 for the respective individual channels 20.

The ink passages 30 are formed in a liquid-passage defining plate constituted by a plurality of components. Each of the ink passages 30 includes a reservoir 30*a*, a manifold 30*b*, a corresponding one of branch passages 30*c*, a corresponding one of pressure chambers 30*d*, a corresponding one of descenders 30*e*, and a corresponding one of the nozzles 30*f*, which are formed in this order from an upstream side and connected to one another. As the plurality of components, the liquid-passage defining plate includes a reservoir member 31, a pressure-chamber plate 32, a liquid-passage plate 33, a protective plate 34, and a nozzle plate 35 which are bonded to one another.

The pressure-chamber plate 32 is a silicon single crystal plate. The pressure chambers 30*d* are formed through the pressure-chamber plate 32 so as to correspond to the respective individual channels 20. Each of the pressure chambers 30*d* is elongated in the orthogonal direction Y, and these pressure chambers 30*d* are arranged in the arrangement direction X.

The liquid-passage plate 33 is bonded to a lower surface of the pressure-chamber plate 32. Through holes as the descenders 30*e* are formed through the liquid-passage plate 33. Each of the decenders 30*e* is connected to one end of a corresponding one of the pressure chambers 30*d* in its longitudinal direction. Through holes as the branch passages 30*c* are also formed through the liquid-passage plate 33. Each of the branch passages 30*c* is connected to the other end of the corresponding pressure chamber 30*d* in its longitudinal direction. A lower surface of the liquid-passage plate 33 has grooves each extending in the orthogonal direction Y. Each of the grooves is connected at one end thereof in its longitudinal direction to a corresponding one of the branch passages 30*c* and at the other end thereof to a corresponding one of through holes formed through the liquid-passage plate 33. These groove and through hole constitute a corresponding one of the manifolds 30*b*.

A flexible damper film 36 is bonded to the lower surface of the liquid-passage plate 33 so as to cover the manifolds 30*b* from below. A spacer 37 shaped like a frame is bonded to a periphery of the damper film 36. The protective plate 34 is bonded to a lower surface of the spacer 37 so as to cover the damper film 36. With this configuration, a portion of each of the ink passages 30 is defined by the damper film 36, whereby the damper film 36 reduces changes in ink pressure.

The nozzle plate 35 is bonded to the lower surface of the liquid-passage plate 33. The nozzles 30*f* are formed through the nozzle plate 35 so as to communicate with the respective descenders 30*e*.

The reservoir member 31 has a relatively large space as the reservoir 30*a*. The reservoir 30*a* is open in a lower surface of the reservoir member 31 and connected to the manifolds 30*b* opening in an upper surface of the liquid-passage plate 33.

The ink passages 30 thus including the reservoir 30*a*, the manifolds 30*b*, the branch passages 30*c*, the pressure chambers 30*d*, the descenders 30*e*, and the nozzles 30*f* are formed independently for each of colors of the ink. Thus, each of the ink passages 30 is filled with the ink of a corresponding one of the colors. The reservoir 30*a* and the manifolds 30*b* are shared among the individual channels 20 corresponding to the same ink color.

There will be next described the piezoelectric elements 40. A vibration plate 41 including a resilient layer 41*a* and an insulating layer 41*b* are provided on an upper surface of the pressure-chamber plate 32. The piezoelectric elements 40 are provided on the vibration plate 41. Each of the piezoelectric elements 40 is constituted by a corresponding one of individual electrodes 42, a corresponding one of piezoelectric layers 43, and a corresponding one of common electrodes 44 which are stacked on one another in this order from a lower side.

The vibration plate 41 is constituted by the lower resilient layer 41*a* and the upper insulating layer 41*b* stacked on each other. The vibration plate 41 is bonded to the upper surface of the pressure-chamber plate 32. The vibration plate 41 closes upper portions of the openings of all the respective pressure chambers 30*d*, in other words, the vibration plate 41 defines upper surfaces of the respective pressure chambers 30*d*. Thus, when the vibration plate 41 is deformed, ejection pressure is applied to the ink in the pressure chamber 30*d*.

The individual electrodes 42 are provided on an upper surface of the vibration plate 41 respectively at positions corresponding to the pressure chambers 30*d* of the respective individual channels 20, in other words, the individual electrodes 42 are provided over the respective pressure chambers 30*d*. Each of the individual electrodes 42 is elongated in the orthogonal direction Y so as to extend along the longitudinal direction of the pressure chamber 30*d*.

The piezoelectric layers 43 are respectively stacked on upper surfaces of the respective individual electrodes 42 so as to cover the respective individual electrodes 42. Each of the piezoelectric layers 43 is one size larger than a corresponding one of the individual electrodes 42 in plan view and formed of a ferroelectric piezoelectric material such as lead zirconium titanate (PZT).

The common electrode 44 are staked on upper surfaces of the respective piezoelectric layers 43. As illustrated in FIG. 3A, the common electrode 44 extends over the individual channels 20 adjacent to one another. That is, the common electrode 44 is shared among the individual channels 20.

The ejection head 16 includes: individual wires 50 each configured to electrically connect a corresponding one of the individual electrodes 42 and the COF 100 to each other; and a collective common wire 60 configured to electrically connect each of the common electrodes 44 and the COF 100 to each other. The individual wires 50 and the collective common wire 60 will be described later in detail. When a particular drive voltage is applied from a driver IC 101 mounted on the COF 100 to the individual electrode 42 and the common electrode 44, the piezoelectric layer 43 interposed between the individual electrode 42 and the common electrode 44 is expanded and contacted to deform the vibration plate 41.

The piezoelectric elements 40 are covered with a protector 45. That is, the protector 45 is shaped like a box opening at its lower side and is disposed such that a space is formed over the common electrode 44 that is the upper most component of each of the piezoelectric elements 40. It is noted that the protector 45 is elongated in the arrangement direction X, and the single protector 45 contains the multiplicity of the piezoelectric elements 40.

Individual Wires and Collective Common Wire

There will be next described the individual wires 50 and the collective common wire 60 with reference to FIG. 2.

As illustrated in FIG. 2, each of the individual wires 50 of the respective individual channels 20 has an elongated strip shape. One end of each of the individual wires 50 is connected to a corresponding one of the individual electrodes 42 (see FIG. 3B). The other end portion of each of the individual wires 50 extends to a portion of the outside connecting region 22 which corresponds to the corresponding individual channel 20. Contacts 51 each formed of an electrically conductive adhesive are provided at the other end portions of the respective individual wires 50. The contacts 51 are respectively electrically connected to individual terminals of the COF 100.

It is noted that each of the individual wires 50 extends from the corresponding individual channel 20 in a direction inclined at a particular angle with respect to the orthogonal direction Y. In the following description, the direction in which each of the individual wires 50 extends may be referred to as "extending direction Q" (see FIG. 2).

As described above, the ejection head 16 includes the two channel rows 21 (i.e., the first channel row 21A and the second channel row 21B) such that the outside connecting region 22 is interposed between the two channel rows 21 in the orthogonal direction Y. Thus, the individual wires 50 extend to the outside connecting region 22 from the individual channels 20 located on opposite sides of the outside connecting region 22 in the orthogonal direction Y. The individual wires 50 extending from the first channel row 21A and the individual wires 50 extending from the second channel row 21B are alternately arranged in the arrangement direction X in the outside connecting region 22.

The collective common wire 60 is provided on an upper surface of the ejection head 16 so as to surround the channel rows 21 and the outside connecting region 22. The collective common wire 60 is connected to the common electrode 44 in each of the individual channels 20 and connected to a collective common terminal of the COF 100 to apply ground potential to the common electrode 44 in each of the individual channels 20.

The collective common wire 60 includes a plurality of portions including first to fourth portions 60*a*-60*d*. Specifically, the first portions 60*a* each extending in the arrangement direction X are provided at a region adjacent to the outside connecting region 22 near the first channel row 21A and a region adjacent to the outside connecting region 22 near the second channel row 21B, respectively (also see FIG. 3B). Each of the first portions 60*a* overlaps portions of corresponding ones of the individual channels 20 so as to be partly connected at these overlapping portions to the common electrode 44 in the corresponding individual channels 20.

The second portions 60*b* are provided for the respective channel rows 21. Each of the second portions 60*b* is located at one end portion of the channel row 21 in the orthogonal direction Y, while a corresponding one of the first portions 60*a* is located at the other end portion of the channel row 21 in the orthogonal direction Y. Like the first portion 60*a*, the second portion 60*b* extends in the arrangement direction X so as to be partly connected to the common electrode 44 in corresponding ones of the individual channels 20.

The two third portions 60*c* are provided for each of the channel rows 21. One of the two third portions 60*c* connects between one ends of the first portion 60*a* and the second portion 60*b* in the arrangement direction X, and the other of the two third portions 60*c* connects between the other ends of the first portion 60*a* and the second portion 60*b* in the arrangement direction X. With these configurations, each of the channel rows 21 is surrounded with the first portions 60*a*, the second portions 60*b*, and the third portions 60*c* of the collective common wire 60 which form a rectangular frame shape.

The collective common wire 60 further includes the two fourth portions 60*d*. One of the fourth portions 60*d* connects between the one end of the first portion 60*a* located near the first channel row 21A and a portion of the collective common wire 60 which is located near the one end of the first portion 60*a* located near the second channel row 21B. The other of the fourth portions 60*d* connects between a portion of the collective common wire 60 which is located near the other end of the first portion 60*a* located near the first channel row 21A and the other end of the first portion 60*a* located near the second channel row 21B. Each of the fourth portions 60*d* has a strip shape and is provided along the extending direction Q.

With these configurations, the first to fourth portions 60*a*-60*d* of the collective common wire 60 are electrically connected to each other. It is noted that the fourth portions 60*d* are respectively located at opposite end portions of the outside connecting region 22 in the arrangement direction X so as to extend across the respective opposite end portions. Contacts 69 are respectively provided on portions of the respective fourth portions 60*d* which overlap the outside connecting region 22. That is, the collective common wire 60 is connected to the collective common terminal of the COF 100 via the contacts 69 at the opposite end portions of the outside connecting region 22 in the arrangement direction X.

Dummy Channel

As illustrated in FIG. 2, an intra-row void 23 is formed at a portion of each of the channel rows 21 in the arrangement direction X. The intra-row void 23 is located between adjacent two of the individual channels 20 which are spaced from each other at a distance greater than the arrangement pitch P. Row-end voids 24 are formed at opposite end portions of each of the channel rows 21 in the arrangement direction X in a region surrounded with the first to third portions 60*a*-60*c* of the collective common wire 60. The individual channels 20 are not formed in the row-end voids 24. In the present embodiment, dummy channels 25 (indicated by narrow one-dot chain lines in FIG. 2) are formed at positions corresponding to the intra-row void 23 and the row-end voids 24. No ink is supplied to the dummy channels 25.

Figure 3C:
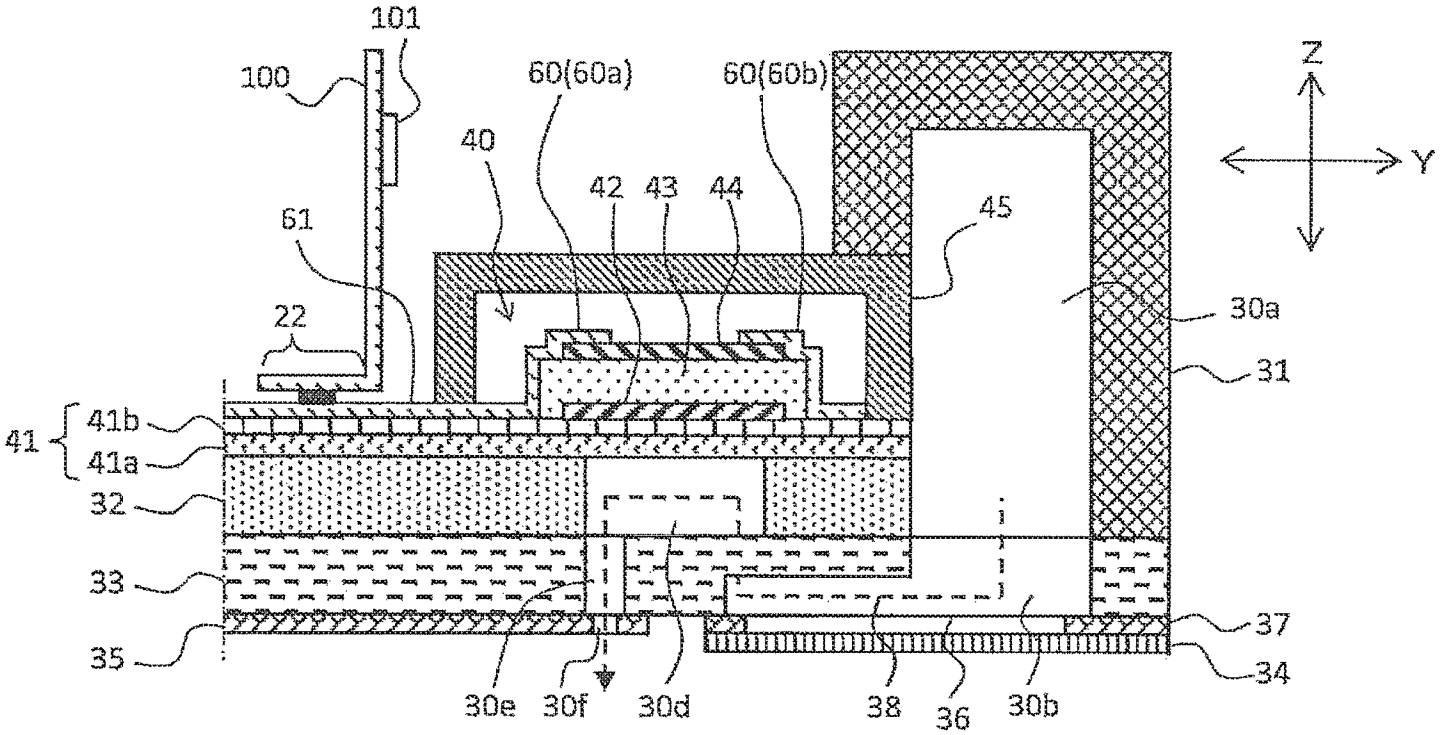
FIG. 3C is a cross-sectional view taken along line IIIC-IIIC in FIG. 2.

As illustrated in FIG. 3C, each of dummy liquid passages 38 defined by the liquid-passage defining plate in the respective dummy channels 25 includes the reservoir 30*a*, the manifold 30*b*, the pressure chamber 30*d*, the descender 30*e*, and the nozzle 30*f* as in the ink passages 30 in the respective individual channels 20. However, each of dummy liquid passages 38 does not include the branch passage 30*c* and is closed between the pressure chamber 30*d* and the manifold 30*b* such that the pressure chamber 30*d* and the manifold 30*b* do not communicate with each other. Thus, no ink is supplied to the pressure chamber 30*d*, the descender 30*e*, and the nozzle 30*f* in each of the dummy channels 25.

In the ejection head 16 according to the present embodiment, each of the channel rows 21 is divided into a plurality of groups of the individual channels 20 by the intra-row voids 23. The ink of one of the colors is supplied to the groups of the individual channels 20 located on one side of the intra-row voids 23 in the arrangement direction X. The ink of another color is supplied to the groups of the individual channels 20 located on the other side of the intra-row voids 23 in the arrangement direction X.

First Common Wire

As illustrated in FIG. 2, first common wires 61 (also see FIG. 3C) are provided at portions of the outside connecting region 22 which correspond to the respective intra-row voids 23. Each of the first common wires 61 extends from a corresponding one of the common electrodes 44 to a corresponding one of the first portions 60*a* of the collective common wire 60. It is noted that an expression like "a portion of the outside connecting region 22 which corresponds to a certain area in the channel row 21" indicates a portion of the outside connecting region 22 which is located on a side of the certain area in the extending direction Q. Accordingly, the portions of the outside connecting region 22 which correspond to the respective intra-row voids 23 indicate areas on the outside connecting region 22, each of which is located on a side of a corresponding one of the intra-row voids 23 in the extending direction. In other words, in the case where the two individual channels adjacent to each other and spaced from each other at the distance greater than the arrangement pitch P in each of the channel rows 21 are defined as a first individual channel and a second individual channel, the intra-row void 23 is provided between the first individual channel and the second individual channel in the channel row 21. Here, in the case where the individual wires 50 extending from the first individual channel and the second individual channel to the outside connecting region 22 are defined as a first individual wire and a second individual wire, the first common wires 61 are provided between the first individual wire and the second individual wire in the outside connecting region 22.

More specifically, the first common wires 61 extend in the extending direction Q to the outside connecting region 22 from the first portion 60*a* of the collective common wire 60 which is located near the first channel row 21A. These first common wires 61 extend from a portion of the first portion 60*a* which overlaps the intra-row void 23, and correspond to the respective dummy channels 25 formed in the intra-row void 23. The first common wires 61 extend such that their respective distal ends are located at the first portion 60*a* located near the second channel row 21B. Accordingly, the first common wires 61 are connected to both of the first portion 60*a* located near the first channel row 21A and the first portion 60*a* located near the second channel row 21B.

Likewise, the first common wires 61 extend in the extending direction Q to the outside connecting region 22 from the first portion 60*a* of the collective common wire 60 in the second channel row 21B. These first common wires 61 extend from a portion of the first portion 60*a* which overlaps the intra-row void 23, and correspond to the respective dummy channels 25 formed in the intra-row void 23. The first common wires 61 extend such that their respective distal ends are located at the first portion 60*a* located near the first channel row 21A. Accordingly, the first common wires 61 are connected to both of the first portion 60*a* located near the first channel row 21A and the first portion 60*a* located near the second channel row 21B.

In the case of the ejection head 16 illustrated in FIG. 2, the intra-row voids 23 in the first channel row 21A and the second channel row 21B are positioned such that portions of the outside connecting region 22 which correspond to the intra-row voids 23 entirely overlap each other. Accordingly, the first common wires 61 extending from the first channel row 21A and the first common wires 61 extending from the second channel row 21B are alternately arranged in the arrangement direction X. In the ejection head 16 according to the present first embodiment, in particular, each of the first common wires 61 is connected to both of the first portion 60*a* located near the first channel row 21A and the first portion 60*a* located near the second channel row 21B. Thus, these first common wires 61 are arranged successively without the individual wires 50 interposed therebetween. The contacts 69 for connection to the common terminal of the COF 100 are provided on upper surfaces of the respective first common wires 61.

Thus, a multiplicity of connections are provided between the COF 100 and each of the common electrodes 44 in the ejection head 16 according to the present embodiment. That is, the connections include not only the contacts 69 provided on the collective common wire 60 (the fourth portions 60*d*) but also the contacts 69 provided on the first common wires 61 provided corresponding to the intra-row voids 23. This configuration ensures more uniform voltages applied to the piezoelectric layers 43 corresponding to the respective individual channels 20. Also, the first common wires 61 are provided at the portions of the outside connecting region 22 which correspond to the intra-row voids 23 and which have a relatively large space. This configuration reduces poor or faulty electrical connection due to increase in the number of the first common wires 61.

The ejection head 16 illustrated in FIG. 2 includes not only the first common wires 61 corresponding to the intra-row voids 23 but also the first common wires 61 corresponding to the row-end voids 24 in the first channel row 21A and the second channel row 21B.

More specifically, the first common wires 61 extend from portions of the first portion 60*a* located near the first channel row 21A, which portions overlap the respective row-end voids 24. These first common wires 61 correspond to the respective dummy channels 25 located in the row-end voids 24. These first common wires 61 extend such that their respective distal ends are located at the first portion 60*a* located near the second channel row 21B. Accordingly, these first common wires 61 are also connected to both of the first portion 60*a* located near the first channel row 21A and the first portion 60*a* located near the second channel row 21B.

The first common wires 61 also extend from portions of the first portion 60*a* located near the second channel row 21B, which portions overlap the respective row-end voids 24. These first common wires 61 correspond to the respective dummy channels 25 located in the row-end voids 24. These first common wires 61 extend such that their respective distal ends are located at the first portion 60*a* located near the first channel row 21A. Accordingly, these first common wires 61 are also connected to both of the first portion 60*a* located near the first channel row 21A and the first portion 60*a* located near the second channel row 21B.

The row-end voids 24 in the first channel row 21A and the second channel row 21B are positioned such that portions of the outside connecting region 22 which correspond to the row-end voids 24 entirely overlap each other. Accordingly, the first common wires 61 extending from the first channel row 21A and the first common wires 61 extending from the second channel row 21B are alternately arranged in the arrangement direction X. The contacts 69 for connection to the common terminal of the COF 100 are provided on the upper surfaces of the respective first common wires 61.

Thus, the contacts 69 are also provided on the respective first common wires 61 provided corresponding to the row-end voids 24 in the ejection head 16 according to the present embodiment. This configuration ensures more uniform voltages applied to the piezoelectric layers 43 corresponding to the respective individual channels 20 and reduces poor or faulty electrical connection as in the configuration in which the first common wires 61 and the contacts 69 are provided corresponding to the intra-row voids 23.

The width of each of the first common wires 61 is not limited in particular. In the ejection head 16 illustrated in FIG. 2, the first common wires 61 and the individual wires 50 have the same width. This configuration ensures uniform application of the adhesive and uniform flowing of the adhesive upon pressing, throughout the wires 50, 61, when each of the wires 50, 61 and the COF 100 are bonded to each other, for example. This facilitates management of a bonding process, resulting in reduction in poor or faulty bonding.

Second Embodiment

Figure 4:
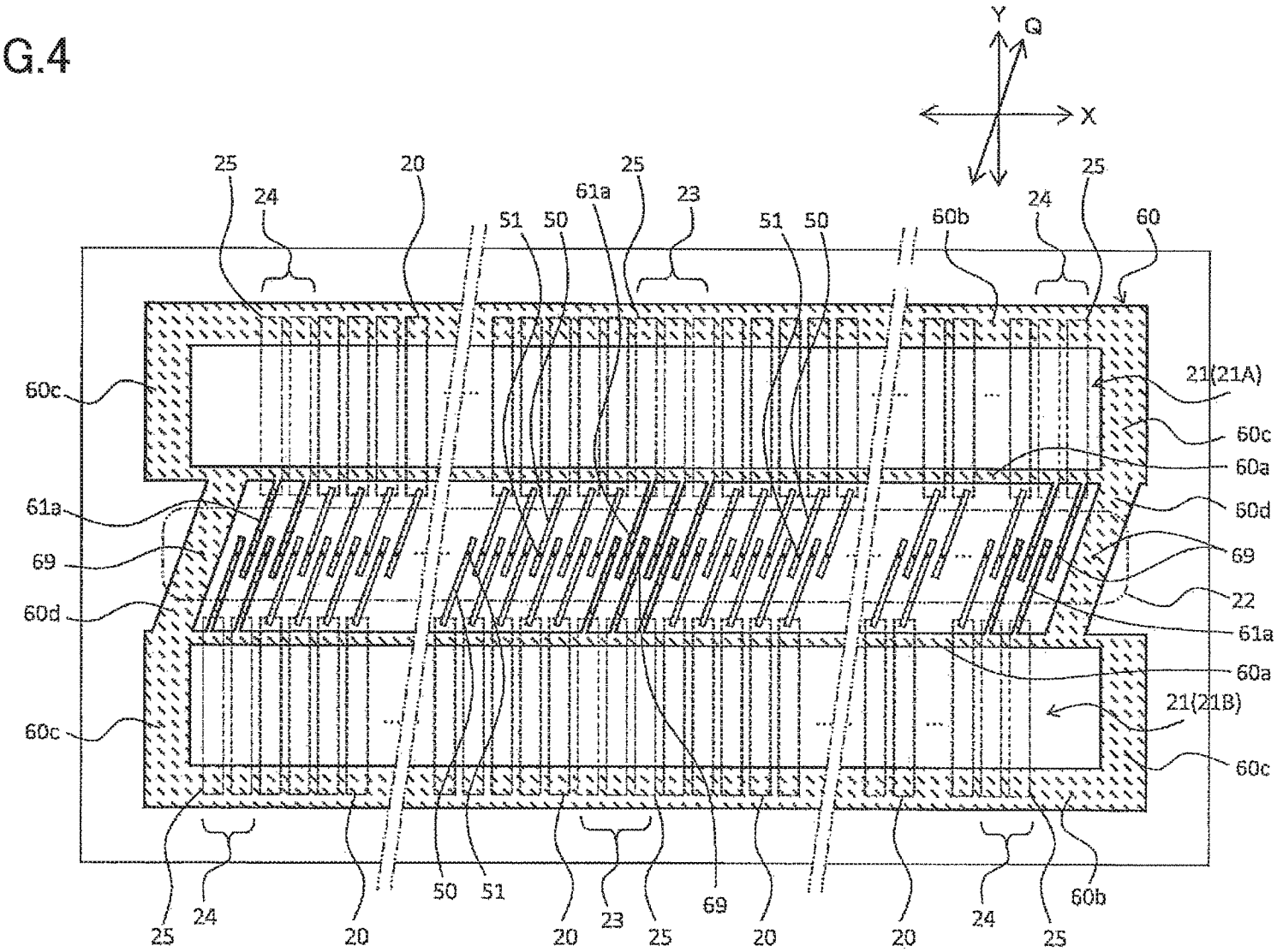
FIG. 4 is a plan view of a liquid ejection apparatus according to a second embodiment.

FIG. 4 illustrates an ejection head 16 (as another example of the liquid ejection apparatus) according to a second embodiment. Each of first common wires 61*a* of the ejection head 16 according to the second embodiment has a length different from that of each of the first common wires 61 of the ejection head 16 according to the first embodiment. The other configuration of the ejection head 16 according to the second embodiment is similar to that of the ejection head 16 according to the first embodiment, and an explanation of which is dispensed with.

In the ejection head 16 according to the second embodiment, as illustrated in FIG. 4, each of the first common wires 61*a* which corresponds to one of the intra-row voids 23 and the row-end voids 24 does not connect between the first portion 60*a* located near the first channel row 21A and the first portion 60*a* located near the second channel row 21B.

More specifically, each of the first common wires 61*a* which corresponds to one of the intra-row void 23 and the row-end voids 24 in the first channel row 21A extends from the first portion 60*a* located near the first channel row 21A toward the first portion 60*a* located near the second channel row 21B but does not reach the first portion 60*a* located near the second channel row 21B. Distal ends of the respective first common wires 61*a* are the same in position in the orthogonal direction Y as distal ends of the individual wires 50 of the respective individual channels 20 corresponding to the first channel row 21A.

Likewise, each of the first common wires 61*a* which corresponds to one of the intra-row void 23 and the row-end voids 24 in the second channel row 21B extends from the first portions 60*a* located near the second channel row 21B toward the first portion 60*a* located near the first channel row 21A but does not reach the first portion 60*a* located near the first channel row 21A. Distal ends of the respective first common wires 61*a* are the same in position in the orthogonal direction Y as distal ends of the individual wires 50 of the respective individual channels 20 corresponding to the second channel row 21B.

In the ejection head 16 configured as described above, as illustrated in FIG. 4, the individual wires 50 and the first common wires 61*a* arranged in the outside connecting region 22 have the same shape. This configuration facilitates placement of the wires 50, 61 and quality control.

Third Embodiment

Figure 5:
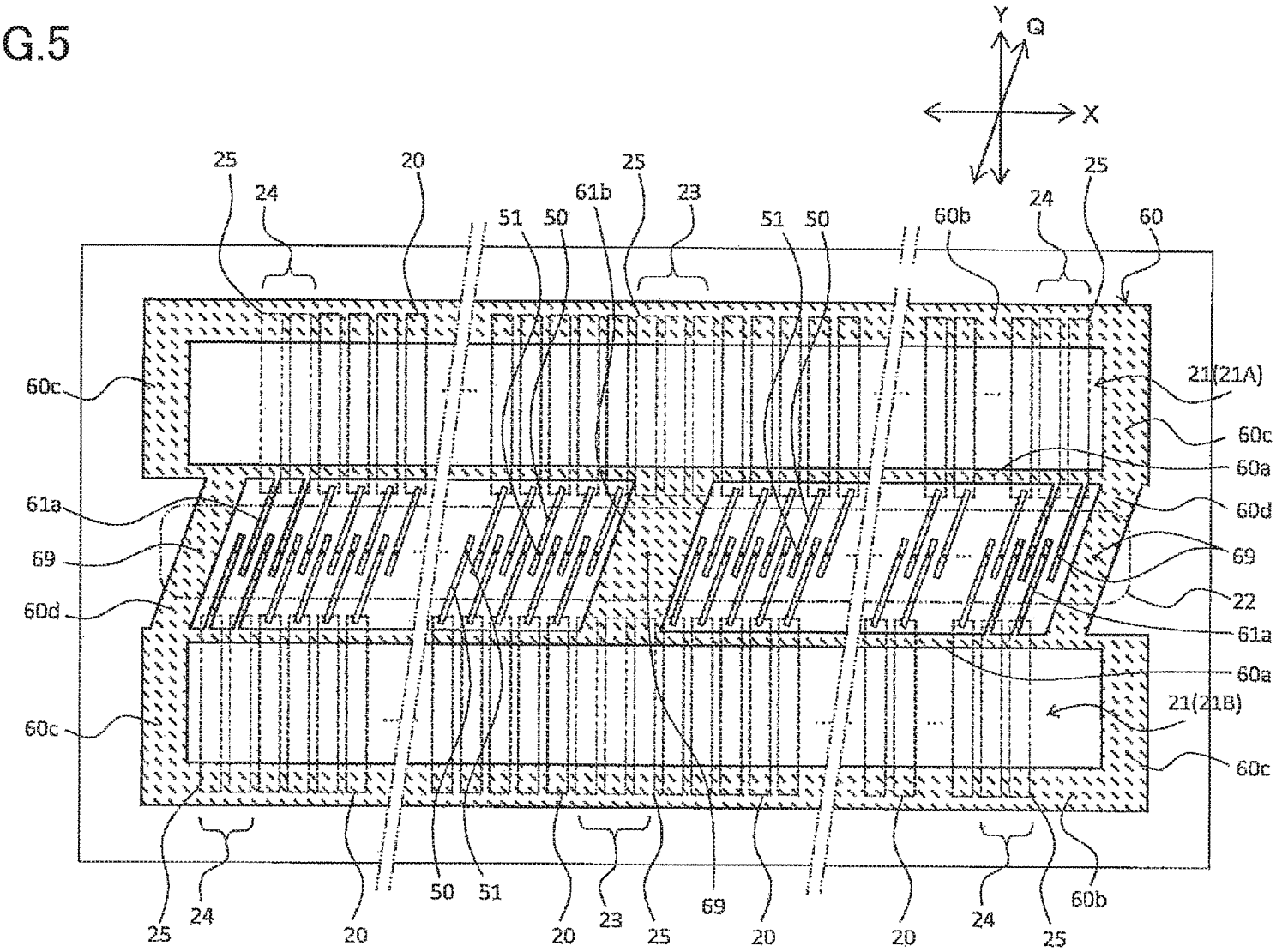
FIG. 5 is a plan view of a liquid ejection apparatus according to a third embodiment.

FIG. 5 illustrates an ejection head 16 (as yet another example of the liquid ejection apparatus) according to a third embodiment. The ejection head 16 according to the third embodiment includes a wide first common wire 61*b*. That is, the first common wire 61*b* corresponding to the intra-row voids 23 of the ejection head 16 according to the third embodiment is wider than each of the first common wires 61*a* corresponding to the intra-row voids 23 of the ejection head 16 according to the second embodiment. The other configuration is similar to that of the ejection head 16 according to the second embodiment.

Specifically, the dummy channels 25 are provided in the intra-row voids 23 of the ejection head 16 according to the third embodiment. Each of the intra-row voids 23 is wider or equal to the arrangement pitch P. Accordingly, a portion of the outside connecting region 22 which corresponds to the intra-row voids 23 is also wider than or equal to the arrangement pitch P. In the ejection head 16 according to the present third embodiment, the first common wire 61*b* wider than each of the first common wires 61*a* in the second embodiment is provided on the wide portion of the outside connecting region 22 which corresponds to the intra-row voids 23.

For example, the width of the first common wire 61*b* in the arrangement direction X is substantially equal to a dimension obtained by multiplying the arrangement pitch P by the number of the dummy channels 25 provided in each of the intra-row voids 23. The contacts 69 for connection to the COF 100 are provided on the first common wire 61*b*.

In the ejection head 16 configured as described above, it is possible to reduce impedance by not only a larger number of the contacts 69 but also a wide passage (the first common wire 61*b*) extending to the contacts 69. This configuration ensures more uniform voltages applied to the respective piezoelectric layers 43.

While the wide first common wire 61*b* corresponding to the intra-row voids 23 is employed in the above-described embodiment, the first common wires 61*a* corresponding to the row-end voids 24 may be made wider instead of or in addition to this configuration.

Fourth Embodiment

Figure 6:
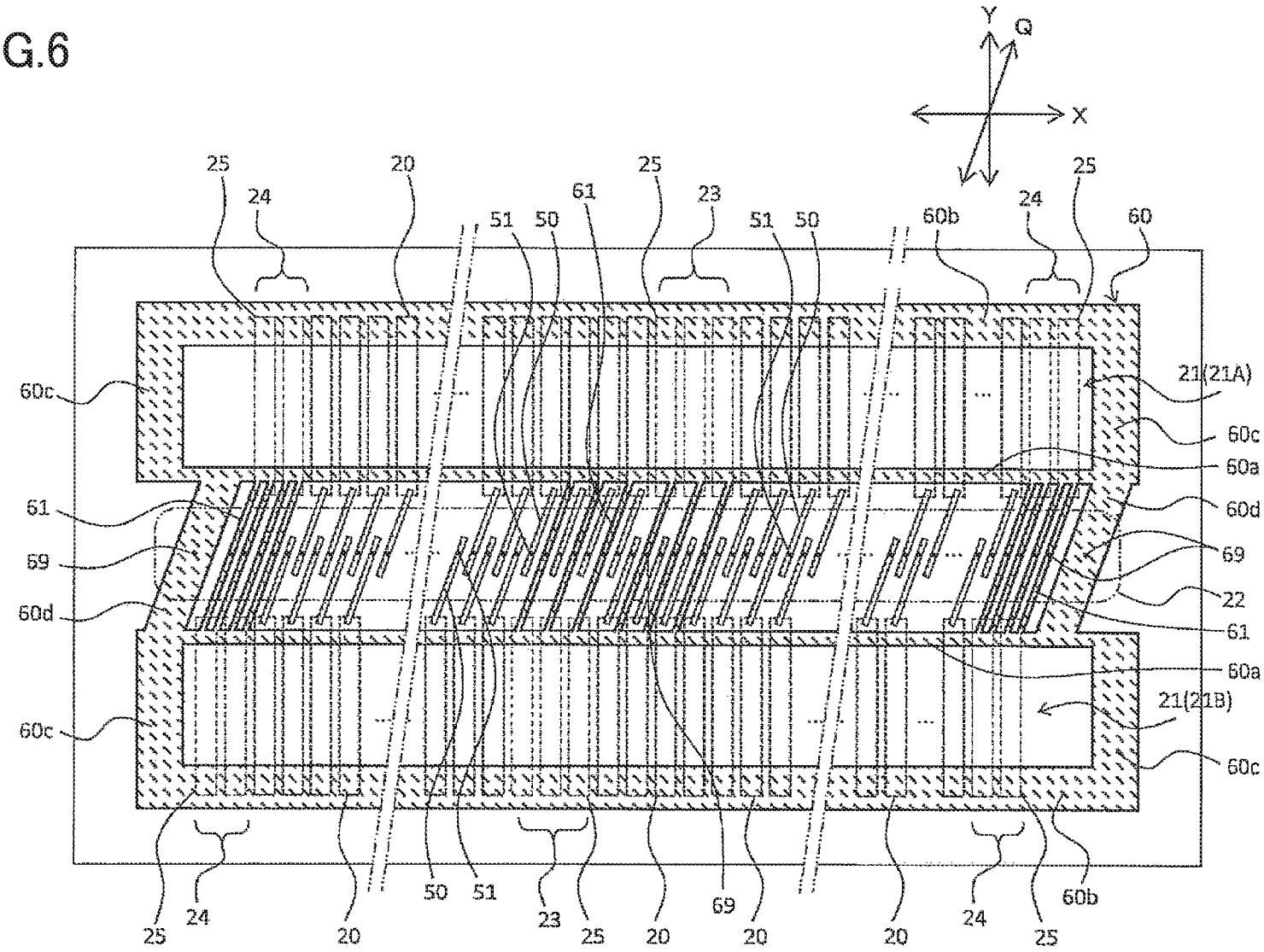
FIG. 6 is a plan view of a liquid ejection apparatus according to a fourth embodiment.

FIG. 6 illustrates an ejection head 16 (as yet another example of the liquid ejection apparatus) according to a fourth embodiment. The ejection head 16 according to the fourth embodiment is different from the ejection head 16 according to the first embodiment in positions of the intra-row voids 23 of the two channel rows 21. Thus, some of the individual wires 50 and some of the first common wires 61 are alternately arranged in the ejection head 16 according to the present fourth embodiment. The other configuration of the ejection head 16 according to the fourth embodiment is similar to that of the ejection head 16 according to the first embodiment.

Specifically, in the ejection head 16 according to the fourth embodiment, a portion of the outside connecting region 22 which corresponds to the intra-row void 23 in the first channel row 21A and a portion of the outside connecting region 22 which corresponds to the intra-row void 23 in the second channel row 21B are different in position from each other in the arrangement direction X. Thus, a portion of the outside connecting region 22 which corresponds to the intra-row void 23 in one of the channel rows 21 and a portion of the outside connecting region 22 which corresponds to some of the individual channels 20 in the other of the channel rows 21 overlap each other.

At this overlapping region in the ejection head 16 according to the fourth embodiment, each of the first common wires 61 extending corresponding to the intra-row void 23 in one of the channel rows 21 is provided between corresponding two of the individual wires 50 extending from the other of the channel rows 21. It is noted that the contacts 69 for connection to the COF 100 are also provided on these first common wires 61.

With this configuration, even in the case where the portions of the outside connecting region 22 which correspond to the respective intra-row voids 23 in the first channel row 21A and the second channel row 21B are different from each other in position, the pattern of arrangement of the individual wires 50 and the first common wires 61 is uniform throughout the entire outside connecting region 22 in the arrangement direction X. This configuration facilitates the management of the bonding process for bonding the ejection head 16 and the COF 100 to each other, resulting in reduction in poor or faulty bonding.

Fifth Embodiment

Figure 7:
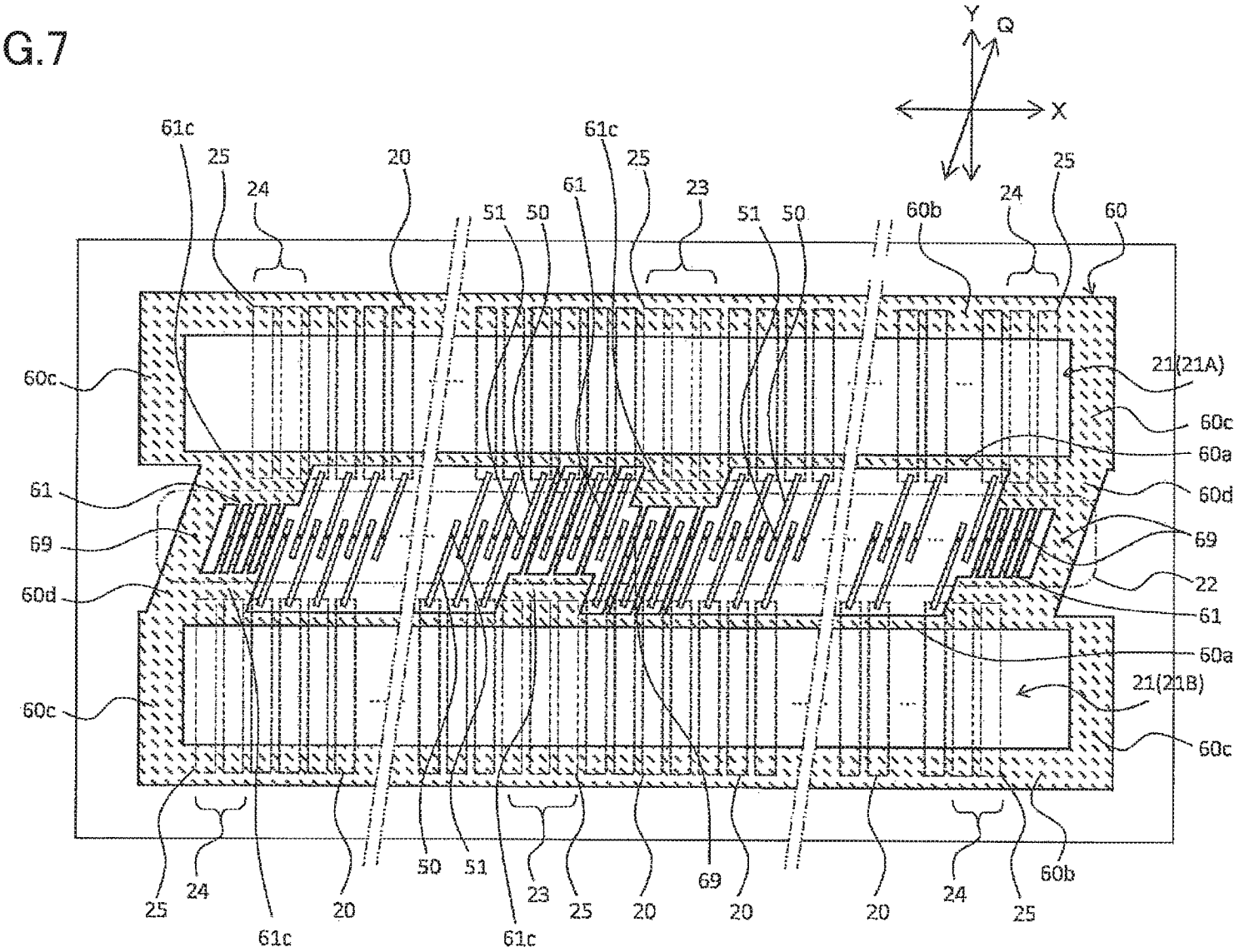
FIG. 7 is a plan view of a liquid ejection apparatus according to a fifth embodiment.

FIG. 7 illustrates an ejection head 16 (as yet another example of the liquid ejection apparatus) according to a fifth embodiment. In the ejection head 16 according to the fifth embodiment, each of the first common wires 61 has a wide base portion. The other configuration of the ejection head 16 according to the fifth embodiment is similar to that of the ejection head 16 according to the fourth embodiment.

Specifically, in the ejection head 16 according to the above-described fourth embodiment, each of the first common wires 61 extending from one of the channel rows 21 is provided between corresponding two of the individual wires 50 extending from the other of the channel rows 21. Thus, each of the first common wires 61 is adjacent to a larger space at its portion not overlapping a corresponding adjacent one of the individual wires 50 in the arrangement direction X than at its portion overlapping the corresponding adjacent one of the individual wires 50 in the arrangement direction X.

Therefore, the ejection head 16 according to the present fifth embodiment is configured such that each of the first common wires 61 which extends between the corresponding adjacent two individual wires 50 is wider at its portion not overlapping the corresponding adjacent individual wire 50 in the arrangement direction X than at its portion overlapping the corresponding adjacent individual wire 50 in the arrangement direction X. As illustrated in FIG. 7, in particular, base portions of some of the first common wires 61 which are adjacent to each other, with each of the individual wires 50 being interposed between corresponding two of the some first common wires 61, are contiguous to each other as a unit so as to form a wide portion 61*c* having a dimension that is a plurality of times greater than the arrangement pitch P.

In the ejection head 16 illustrated in FIG. 7, the wide portions 61*c* are formed at the base portions of both of the first common wires 61 corresponding to the intra-row voids 23 and the first common wires 61 corresponding to the row-end voids 24.

This configuration reduces impedance of the common wires, resulting in more uniform voltages applied to the respective piezoelectric layers 43.

Sixth Embodiment

Figure 8:
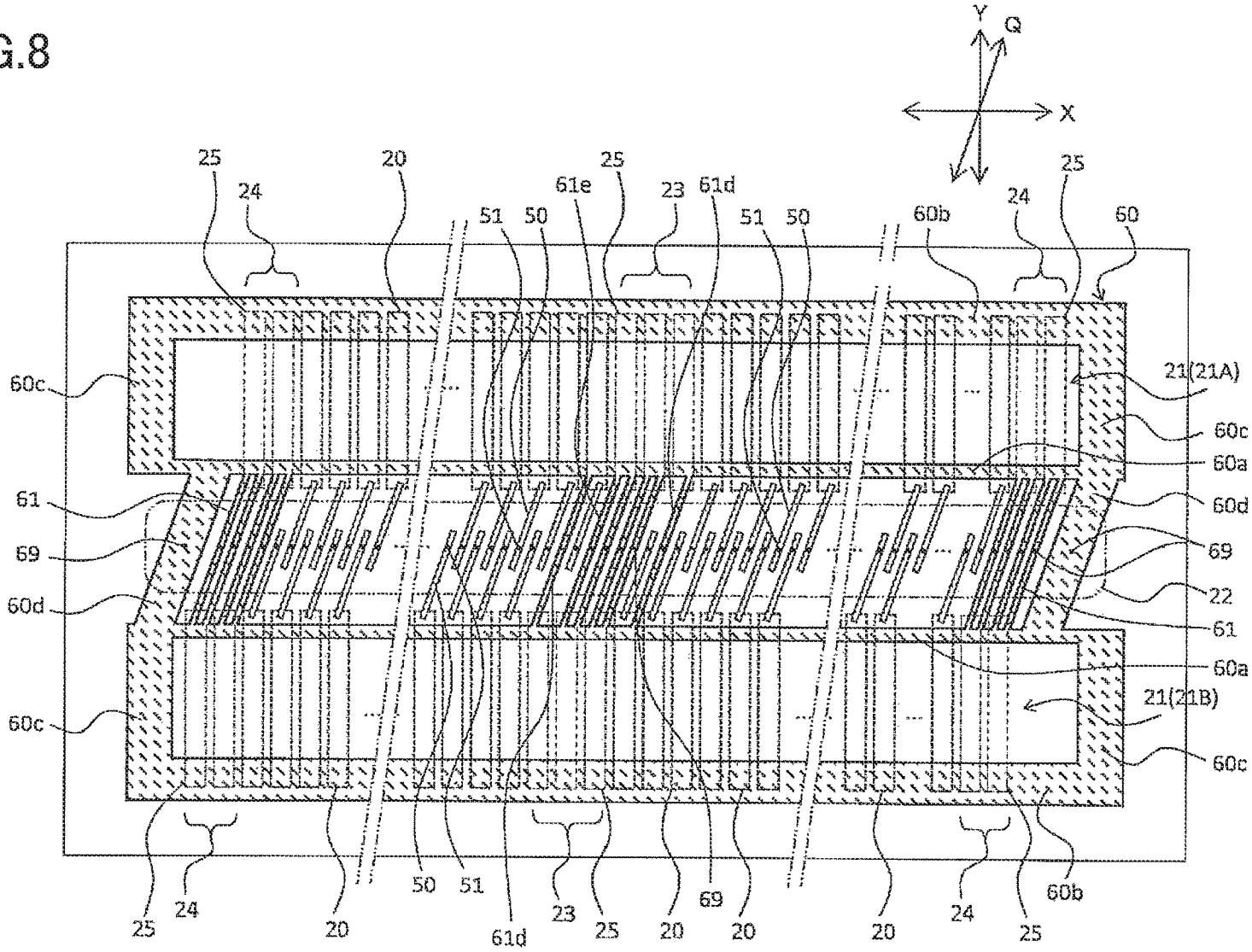
FIG. 8 is a plan view of a liquid ejection apparatus according to a sixth embodiment.

FIG. 8 illustrates an ejection head 16 (as yet another example of the liquid ejection apparatus) according to a sixth embodiment. The ejection head 16 according to the sixth embodiment is different from the ejection head 16 according to the fourth embodiment in positions of the intra-row voids 23 in the two channel rows 21. Thus, the ejection head 16 according to the present sixth embodiment includes: a portion at which the individual wires 50 and the first common wires 61 are alternately arranged; and a portion at which the first common wires 61 are arranged in the same pitch as a pitch in which the individual wires 50 and the first common wires 61 are alternately arranged in the portion. The other configuration is similar to that of the ejection head 16 according to the fourth embodiment.

Specifically, in the ejection head 16 according to the sixth embodiment, a portion of the outside connecting region 22 which corresponds to the intra-row void 23 in the first channel row 21A and a portion of the outside connecting region 22 which corresponds to the intra-row void 23 in the second channel row 21B partly overlap each other in the arrangement direction X. In other words, the portion of the outside connecting region 22 which corresponds to the intra-row void 23 in the first channel row 21A and the portion of the outside connecting region 22 which corresponds to the intra-row void 23 in the second channel row 21B are partly different from each other in position.

In the region in which the portions of the outside connecting region 22 are partly different from each other, as in the fourth embodiment, the individual wires 50 extending from one of the channel rows 21 and the first common wires 61 extending from the other of the channel rows 21 (hereafter may be referred to as "first common wires 61*d*") are alternately arranged.

In the region in which the portions of the outside connecting region 22 partly overlap each other, only the first common wires 61 (hereafter may be referred to as "first common wires 61*e*") are provided. The first common wires 61*e* are arranged in the same pitch as a pitch in other portions of the outside connecting region 22, especially, in the same pitch as a pitch in which the individual wires 50 and the first common wires 61*d* are arranged in the region in which the portions of the outside connecting region 22 are partly different from each other. It is noted that the contacts 69 for connection to the COF 100 are also provided on the first common wires 61*d*, 61*e*.

This configuration increases the number of the contacts for connection to the COF 100 and ensures uniform pattern of arrangement of the individual wires 50 and the first common wires 61.

Seventh Embodiment

Figure 9:
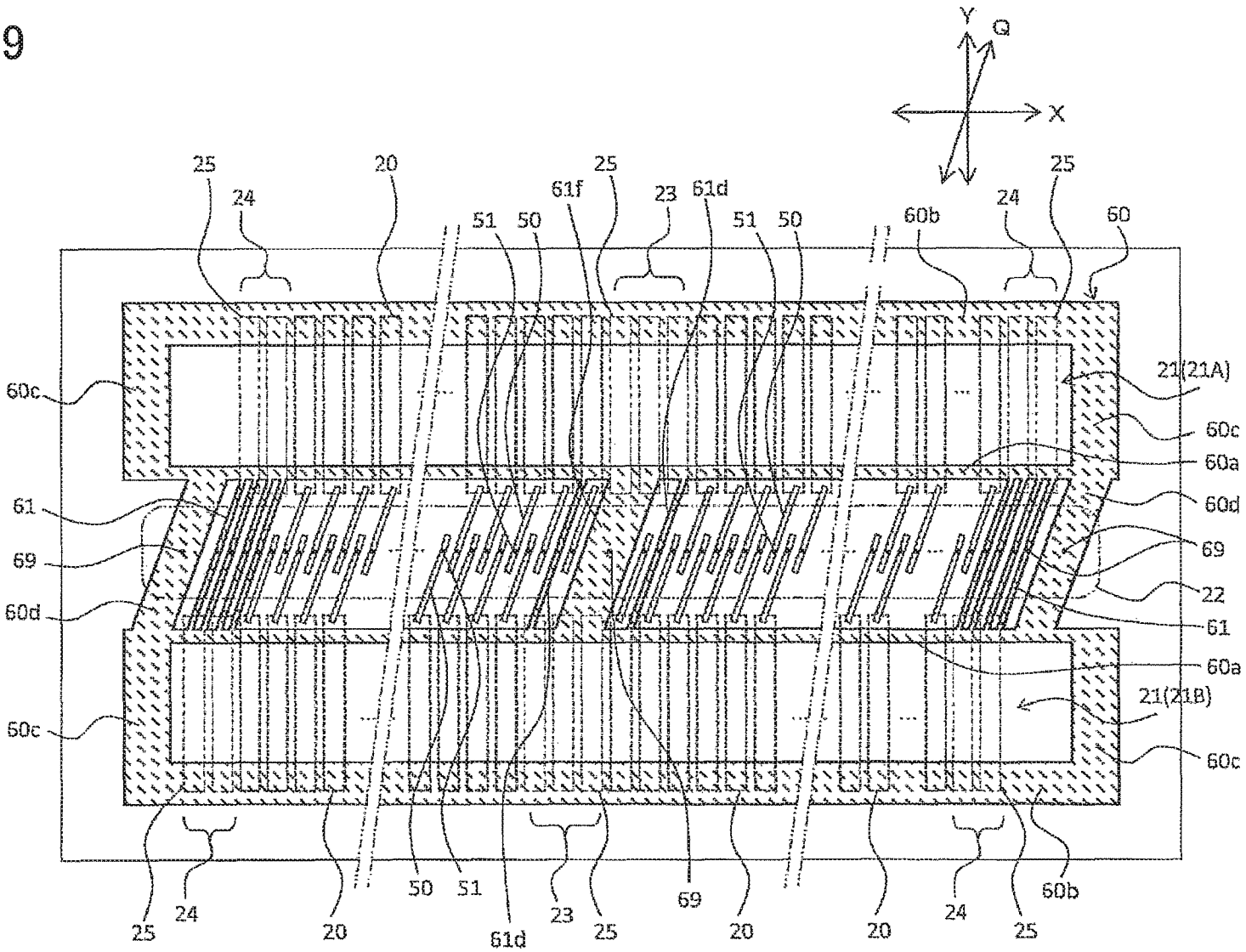
FIG. 9 is a plan view of a liquid ejection apparatus according to a seventh embodiment.

FIG. 9 illustrates an ejection head 16 (as yet another example of the liquid ejection apparatus) according to a seventh embodiment. The ejection head 16 according to the seventh embodiment is similar in configuration to the ejection head 16 according to the sixth embodiment for the most part. The first common wires 61*e* adjacent to each other in the ejection head 16 according to the sixth embodiment are modified to a single wide wire (hereafter may be referred to as "first common wire 61*f*") in the ejection head 16 according to the present seventh embodiment.

This configuration reduces impedance of the common wires, resulting in more uniform voltages applied to the respective piezoelectric layers 43.

Eighth Embodiment

Figure 10:
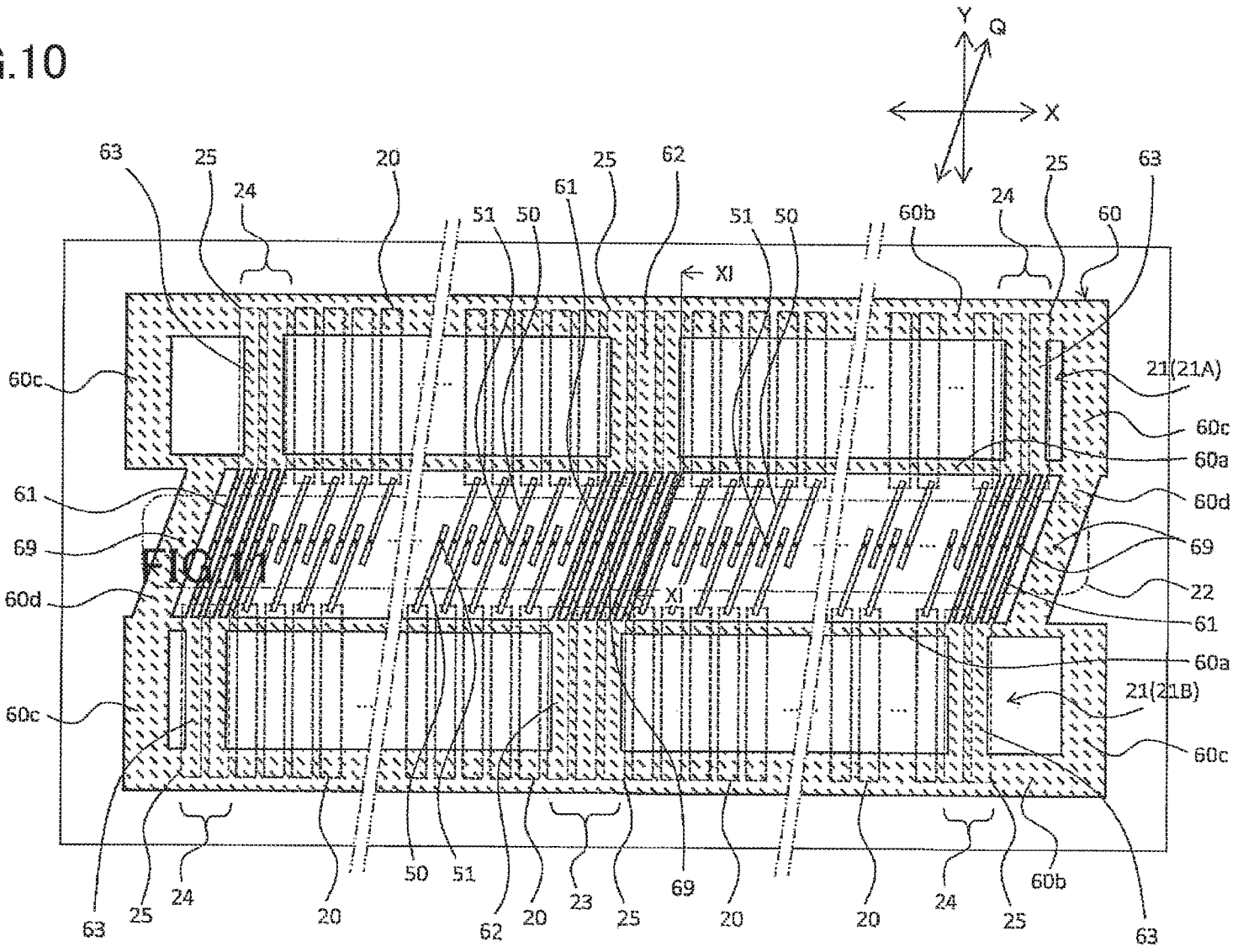
FIG. 10 is a plan view of a liquid ejection apparatus according to an eighth embodiment.
Figure 11:
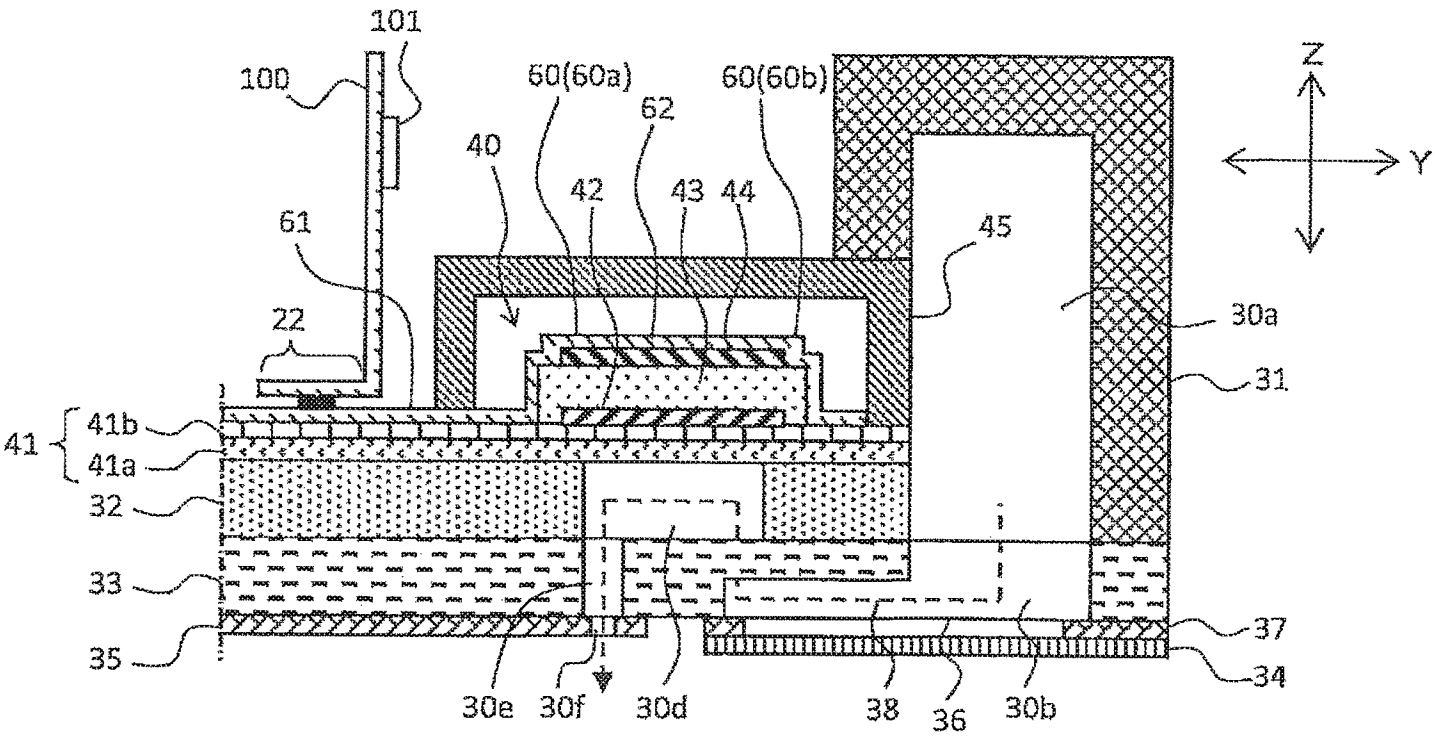
FIG. 11 is a cross-sectional view taken along line XI-XI in FIG. 10.

FIG. 10 illustrates an ejection head 16 (as yet another example of the liquid ejection apparatus) according to an eighth embodiment. FIG. 11 is a cross-sectional view taken along line XI-XI in FIG. 10. The ejection head 16 according to the eighth embodiment is different from the ejection head 16 according to the first embodiment in that common wires as second common wires 62 are provided at the intra-row voids 23, and common wires as third common wires 63 are provided at the row-end voids 24. It is noted that the other configuration of the ejection head 16 according to the eighth embodiment is similar to that of the ejection head 16 according to the first embodiment.

Specifically, in the ejection head 16 according to the present eighth embodiment, as illustrated in FIG. 10, the collective common wire 60 is provided so as to surround each of the channel rows 21. In each of the intra-row voids 23 of the respective channel rows 21, as illustrated in FIGS. 10 and 11, each of the second common wires 62 is provided so as to connect between corresponding portions of the collective common wire 60 which are opposed to each other with the intra-row void 23 therebetween. In other words, each of the second common wires 62 connects a corresponding one of the first portions 60*a* and a corresponding one of the second portions 60*b* to each other.

In each of the row-end voids 24, likewise, each of the third common wires 63 is provided so as to connect between corresponding portions of the collective common wire 60 which are opposed to each other with the row-end void 24 therebetween. In other words, each of the third common wire 63 connects a corresponding one of the first portions 60*a* and a corresponding one of the second portions 60*b* to each other.

This configuration reduces impedance of the common wires, resulting in more uniform voltages applied to the respective piezoelectric layers 43.

It is noted that both of the second common wires 62 and the third common wires 63 are not necessarily provided, and only one kind of the second common wires 62 and the third common wires 63 may be provided. Each of the second common wires 62 provided in the respective intra-row voids 23 may be divided into a plurality of common wires each having a smaller width and may be a single wide common wire as illustrated in FIG. 10 by maximizing utilization of the space of the intra-row void 23. This applies to the third common wires 63.

While the embodiments have been described above, it is to be understood that the disclosure is not limited to the details of the illustrated embodiments, but may be embodied with various changes and modifications, which may occur to those skilled in the art, without departing from the spirit and scope of the disclosure. For example, while the present disclosure is applied to the ink ejection heads as the examples of the liquid ejection apparatus in the above-described embodiments, the present disclosure is not limited to this configuration. The present disclosure may be applied to liquid ejection apparatuses configured to eject liquid other than the ink. While the line ejection head is used as the liquid ejection apparatus in each of the above-described embodiments, the present disclosure is not limited to this configuration. For example, the present disclosure may be applied to a scanning ejection head configured to eject the ink while being reciprocated in a direction orthogonal to a direction in which a recording medium is conveyed.

The collective common wire 60 is provided in each of the above-described embodiments. However, the collective common wire 60 is not essential from the viewpoint of ensuring uniform voltages applied to the respective piezoelectric layers 43. For example, the first common wire 61 may extend directly to the outside connecting region 22 from the common electrode 44 in each of the individual channels 20 to ensure uniform voltages applied to the respective piezoelectric layers 43.

The present disclosure may be applied to liquid ejection apparatuses such as an ink-jet printer.

What is claimed is:

1. A liquid ejection apparatus, comprising:

a plurality of channel rows each comprising a plurality of individual channels to which liquid is to be supplied, the plurality of individual channels being arranged in an arrangement pitch in an arrangement direction;

a plurality of piezoelectric elements each constituted by an individual electrode, a common electrode, and a piezoelectric layer interposed between the individual electrode and the common electrode, the plurality of piezoelectric elements each provided for a corresponding one of the plurality of individual channels; and a plurality of individual wires respectively extending from a plurality of individual electrodes, each as the individual electrode, to an outside connecting region located adjacent to the plurality of channel rows, the plurality of individual wires being to be connected to an external circuit board, the plurality of individual wires each comprising a contact to be connected to an individual terminal of the external circuit board, wherein a portion of each of the plurality of channel rows in the arrangement direction comprises an intra-row void that is a region between two of the plurality of individual channels, which two are adjacent to and spaced apart from each other at a distance greater than the arrangement pitch, wherein each of the plurality of individual wires extends to a portion of the outside connecting region which corresponds to a corresponding one of the plurality of individual channels, and wherein a first common wire extending from the common electrode and to be connected to a common terminal of the external circuit board is provided at a portion of the outside connecting region which corresponds to the intra-row void.

2. The liquid ejection apparatus according to claim 1, wherein a collective common wire connected to a plurality of common electrodes each as the common electrode and to be connected to a collective common terminal of the external circuit board is provided along the arrangement direction at a channel-row-side region adjacent to the outside connecting region, and wherein the first common wire extends from the collective common wire to the portion of the outside connecting region which corresponds to the intra-row void.

3. The liquid ejection apparatus according to claim 2, wherein the collective common wire is to be connected to the collective common terminal of the external circuit board at an end portion of the outside connecting region in the arrangement direction.

4. The liquid ejection apparatus according to claim 2, wherein the plurality of channel rows comprise a first channel row and a second channel row, and the outside connecting region is located between the first channel row and the second channel row, wherein the plurality of individual wires extending from the first channel row and the second channel row extend to the outside connecting region, wherein the collective common wire comprises: a first-channel-row-side portion adjacent to the outside connecting region and extending in the arrangement direction; and a second-channel-row-side portion adjacent to the outside connecting region and extending in the arrangement direction, wherein a portion of the first common wire extends from the first-channel-row-side portion at a portion of the outside connecting region which corresponds to the intra-row void of the first channel row, and wherein a portion of the first common wire extends from the second-channel-row-side portion at a portion of the outside connecting region which corresponds to the intra-row void of the second channel row.

5. The liquid ejection apparatus according to claim 4, wherein the first common wire is connected to the first-channel-row-side portion and to the second-channel-row-side portion.

6. The liquid ejection apparatus according to claim 4, wherein the portion of the outside connecting region which corresponds to the intra-row void of the first channel row and the portion of the outside connecting region which corresponds to the intra-row void of the second channel row are different from each other in position in the arrangement direction, and wherein the first common wire corresponding to the intra-row void of one of the first channel row and the second channel row is located between two of the plurality of individual wires which extend from another of the first channel row and the second channel row.

7. The liquid ejection apparatus according to claim 6, wherein a width of the first common wire and a width of each of the plurality of individual wires are equal to each other.

8. The liquid ejection apparatus according to claim 6, wherein the portion of the outside connecting region which corresponds to the intra-row void of the first channel row and the portion of the outside connecting region which corresponds to the intra-row void of the second channel row overlap each other at an overlapping region in position in the arrangement direction, and wherein a plurality of first common wires each as the first common wire are arranged at the overlapping region in a pitch identical to a pitch at a portion of the outside connecting region which is different from the overlapping region.

9. The liquid ejection apparatus according to claim 6, wherein the portion of the outside connecting region which corresponds to the intra-row void of the first channel row and the portion of the outside connecting region which corresponds to the intra-row void of the second channel row overlap each other at an overlapping region in position in the arrangement direction, and wherein the first common wire having a width greater than that of each of the plurality of individual wires is provided at the overlapping region.

10. The liquid ejection apparatus according to claim 6, wherein the first common wire extending between adjacent two individual wires of the plurality of individual wires comprises a portion not overlapping the two individual wires in the arrangement direction and a portion overlapping the two individual wires in the arrangement direction, and a width of the portion not overlapping the two individual wires is greater than a width of the portion overlapping the two individual wires.

11. The liquid ejection apparatus according to claim 2, wherein the collective common wire surrounds the plurality of channel rows, and wherein a second common wire is provided at the intra-row void so as to connect between portions of the collective common wire which are opposed to each other, with the intra-row void interposed between the portions of the collective common wire.

12. The liquid ejection apparatus according to claim 11, wherein a row-end void that is a region at which the plurality of individual channels are not formed is formed at an end portion of each of the plurality of channel rows in the arrangement direction in a region surrounded by the collective common wire, and wherein a portion of the first common wire is provided at a portion of the outside connecting region which corresponds to the row-end void.

13. The liquid ejection apparatus according to claim 12, wherein a third common wire is provided at the row-end void so as to connect between other portions of the collective common wire which are opposed to each other, with the row-end void interposed between said other portions of the collective common wire.

14. The liquid ejection apparatus according to claim 1, wherein the liquid of a particular color is to be supplied to a group of individual channels located on one side of the intra-row void in the arrangement direction among the plurality of individual channels of each of the plurality of channel rows, and the liquid of a color different from the particular color is to be supplied to a group of individual channels located on another side of the intra-row void in the arrangement direction among the plurality of individual channels of said each of the plurality of channel rows.

15. The liquid ejection apparatus according to claim 1, wherein the intra-row void is formed at a dummy channel to which the liquid is not to be supplied, and the dummy channel is formed between adjacent two of the plurality of individual channels, which two are spaced apart from each other at a distance greater than the arrangement pitch.

16. The liquid ejection apparatus according to claim 1, wherein a collective common wire connected to a plurality of common electrodes each as the common electrode and to be connected to a collective common terminal of the external circuit board is provided, and wherein a plurality of contacts are provided on the collective common wire and the first common wire so as to make connection to the collective common terminal and the common terminal of the external circuit board.

* * * * *